United States Patent [19]

Kaneko

[11] 4,393,778

[45] Jul. 19, 1983

[54] DEVICE FOR WASHING BLANKET CYLINDER OF ROTARY OFFSET PRESS

[75] Inventor: Toshihisa Kaneko, Tokyo, Japan

[73] Assignee: Dai Nippon Insatsu Kabushiki Kaisha, Tokyo, Japan

[21] Appl. No.: 283,440

[22] Filed: Jul. 15, 1981

[51] Int. Cl.[3] ..... B41F 35/06; B41L 41/06

[52] U.S. Cl. ..... 101/425

[58] Field of Search ..... 101/425, 148, 350, 363, 101/364, 207–208, 210, 423, 424, 155, 167; 15/256.52

[56] References Cited

U.S. PATENT DOCUMENTS

| | | | |
|---|---|---|---|
| 2,731,916 | 1/1956 | Koch | 101/425 |
| 2,746,387 | 5/1956 | Neumann | 101/155 |
| 2,987,993 | 6/1961 | Giori | 101/167 X |
| 3,309,993 | 3/1967 | Grembecki et al. | 101/425 |
| 4,015,307 | 4/1977 | Kossak | 101/425 |
| 4,048,919 | 9/1977 | Woods | 101/350 |

FOREIGN PATENT DOCUMENTS

| | | | |
|---|---|---|---|
| 548280 | 3/1932 | Fed. Rep. of Germany | 101/167 |
| 1124974 | 3/1962 | Fed. Rep. of Germany | 101/425 |
| 1254439 | 11/1971 | United Kingdom | 101/425 |
| 2040811 | 9/1980 | United Kingdom | 101/425 |

*Primary Examiner*—J. Reed Fisher

*Attorney, Agent, or Firm*—Koda and Androlia

[57] ABSTRACT

In a device for washing a blanket cylinder of a rotary offset press, a housing for enclosing a brush roll and washing-water-spraying nozzles has a trough along its bottom and a ceiling plate with a bent part from which the ceiling plate extends obliquely upward with an eave-like shape, whereby droplets of washing liquid slung upward flow downward along the ceiling plate toward the bent part to drip onto the brush roll and not onto the blanket cylinder. A flushing nozzle is additionally provided for flushing the bottom trough thereby to prevent accumulation of sludge.

5 Claims, 13 Drawing Figures

DEVICE FOR WASHING BLANKET CYLINDER OF ROTARY OFFSET PRESS

BACKGROUND OF THE INVENTION

This invention relates generally to rotary offset printing presses and more particularly to a device for washing one or more blanket cylinders in a rotary offset press such as those of the B-B type having two opposite blanket cylinders or the satellite type having a plurality of blanket cylinders around a single impression cylinder.

In general, in a rotary offset press, after a long period of operation, foreign substances such as residual ink which has accumulated and hardened, paper dust, and clay are found to be adhering to the surface or surfaces of the blanket cylinder or cylinders. These impurities greatly impair the printing quality of the press.

As is known, a rotary offset press of the general B-B type is a perfecting press or perfector, in which a sheet of paper is passed between and pressed by a pair of blanket cylinders and thus simultaneously printed on its two surfaces, and in which a plate cylinder is in contact parallelly with each blanket cylinder on the side thereof remote from the paper. Ordinarily, the axes of the cylinders are horizontal, and one blanket cylinder is disposed above the other.

Heretofore, it has been necessary in order to wash the blanket cylinders in such a press to once stop the press and wash the surfaces of the blanket cylinders by hand. This procedure naturally results in a great loss of time and labor.

With the aim of automatizing this washing work, there has been proposed a device in which a brush roll is placed in contact with each blanket cylinder, and a washing liquid is jetted onto the blanket cylinder surface along a line in front of the position of the contact as viewed in the rotational direction of the blanket cylinder. In this device, it is desirable that each blanket cylinder and its brush roll rotate in the same direction so that their mutually facing peripheral surfaces will travel in opposite directions and that relative peripheral speed at their contact position will be high, and therefore the washing effectiveness will be high.

However, in a rotary offset press with a washing device of this character, the washing liquid tends to be slung upward from the lower blanket cylinder and to collide with the upper part of the brush roll housing, becoming droplets. A portion of these droplets drops onto the blanket cylinder and continues to drop long after completion of the washing, thereby contaminating the printing.

Another problem encountered in a washing device of the instant character is that of the drainage of the used washing liquid and accumulated impurities. More specifically, after several washings, a sludge-like substance including ink, paper dust, clay, etc., accumulates on and raises the level of the bottom of the housing. As a result of tests, it has been found that, after a number of weeks of use, the waste washing liquid, which should be drained, overflows out of the housing and impairs the printing quality. Furthermore, the work of removing the sludge-like substance is extremely troublesome.

As measures to solve this problem, it has been tried to provide the lower part of the housing with a slope and providing means for sucking out the impurities but it has been found that such measures are inadequate.

SUMMARY OF THE INVENTION

It is an object of this invention to provide a device for the washing of the blanket cylinder of a rotary offset press in which device the above problems have been solved.

According to this invention, briefly summarized, there is provided a device for washing a blanket cylinder of a rotary offset press, which device comprises a brush roll adapted to rotate about an axis parallel to the axis of the blanket cylinder, in the same rotational direction as the blanket cylinder, and in pressed state in a region of contact against the blanket cylinder, a spraying device for spraying a washing liquid against the blanket cylinder at a part thereof in front of the region of contact as viewed in the rotational direction of the blanket cylinder, and a housing enclosing the brush roll and the spraying device, functioning to prevent the washing liquid from scattering undesirably to other parts of the press, and having a trough at the bottom thereof for collecting waste washing liquid and foreign matter washed off, characterized in that the housing has a ceiling plate having a bent part from which the ceiling plate extends obliquely upward with an eave-like shape toward an edge in close proximity of the blanket cylinder, whereby droplets of the washing liquid slung upward against the ceiling plate flow downward therealong toward the bent part to drip onto the brush roll and not onto the blanket roll.

In the device for washing for washing a blanket cylinder as set forth above, there may be further provided a flushing nozzle for projecting a jet of a cleaning liquid along said trough at the bottom of the housing thereby to flush away foreign matter toward a drain outlet and thereby to prevent accumulation of sludge in the trough.

The nature, utility, and further features of this invention will become more clearly apparent from the following detailed description with respect to preferred embodiments of the invention when read in conjunction with the accompanying drawings, briefly described below.

DETAILED DESCRIPTION OF THE INVENTION

Figure 1:
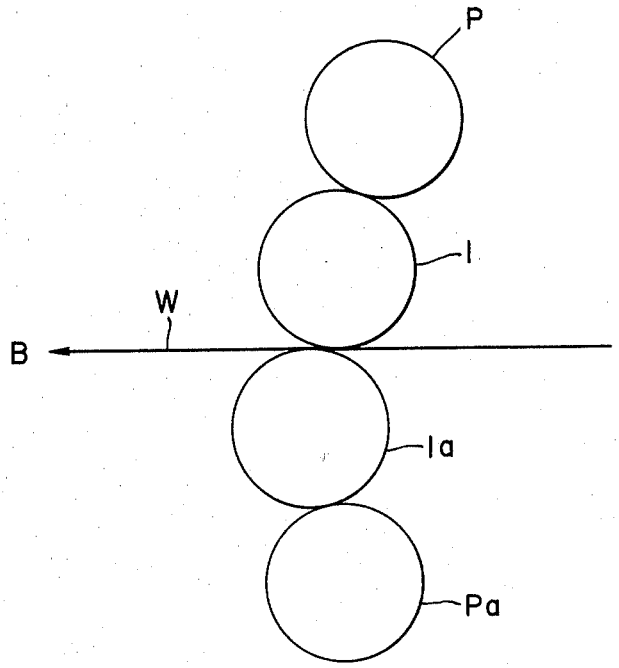
FIG. 1 is a schematic diagram, in side elevation, showing the essential parts of the printing mechanism of a B-B type printing press.

An example of a rotary offset press of the general B-B type is illustrated schematically in FIG. 1. As mentioned briefly hereinbefore, this is a perfecting press, in which a long sheet of print paper W traveling in a direction B is passed between and pressed by a pair of upper and lower blanket cylinders 1 and 1*a* and thus simultaneously printed on its two surfaces. Plate cylinders P and Pa are in contact parallelly with the blanket cylinders 1 and 1*a*, respectively, on their sides remote from the print paper W.

Figure 2:
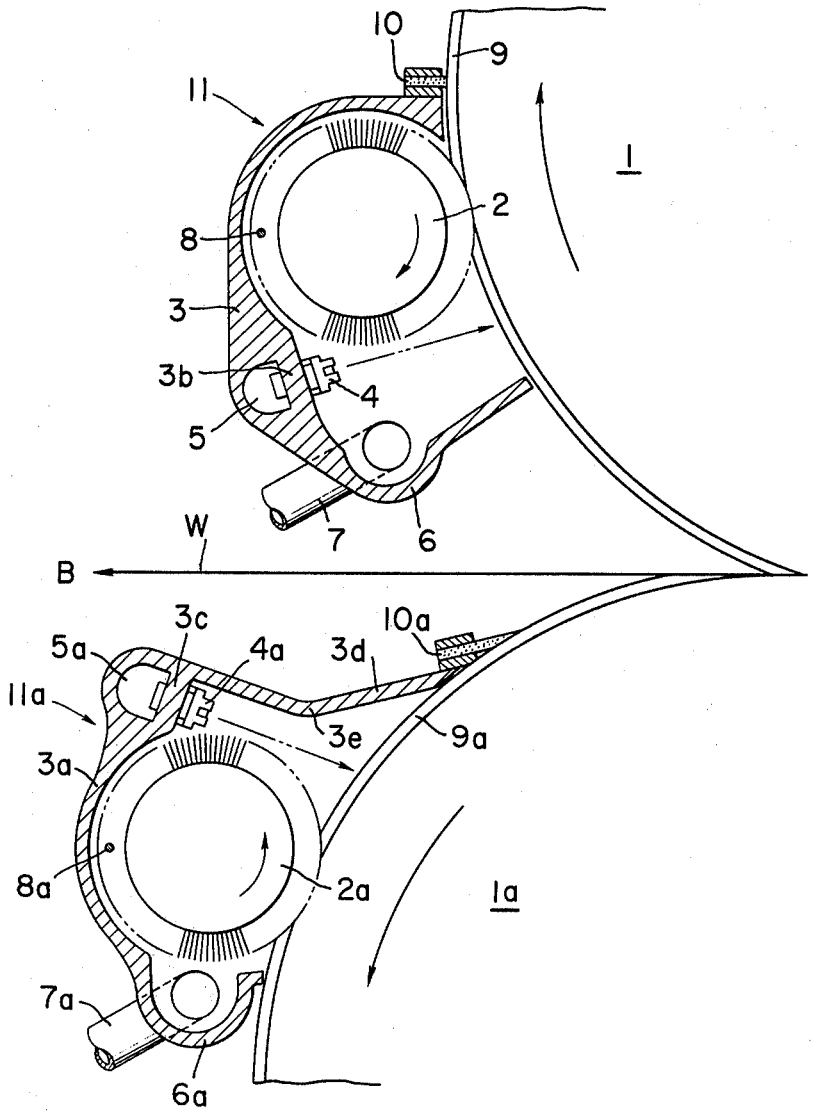
FIG. 2 is a partial side elevation, with parts in vertical section, showing the essential parts of one example of the washing device according to this invention.
Figure 3:
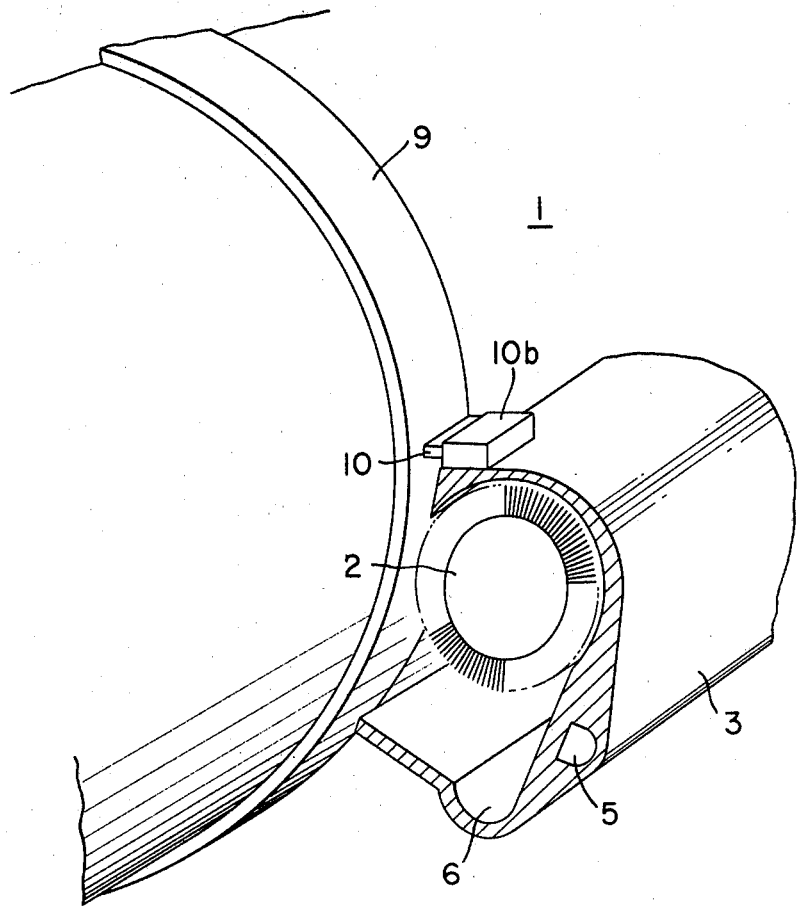
FIG. 3 is fragmentary perspective view, with parts cut away and parts shown in vertical section, of the upper washing unit of the washing device shown in FIG. 2.

In an embodiment of this invention as shown in FIGS. 2 and 3, the washing device comprises an upper washing unit 11 and a lower washing unit 11*a* for cleaning or washing the upper and lower blanket cylinders 1 and 1*a*, respectively, of a rotary offset press of the B-B type as illustrated in FIG. 1.

The upper and lower washing units 11 and 11*a* respectively have rotating brush rolls 2 and 2*a* for contacting parallelly the upper and lower blanket cylinders 1 and 1*a*, respectively. The upper and lower brush rolls 2 and 2*a*, during operation, rotate in the same directions as their blanket cylinders 1 and 1*a*, respectively, or clockwise and counterclockwise, respectively, as viewed in FIG. 2. It will be obvious that these rotational directions result in a higher relative peripheral speed at the region of contact between each brush roll and its corresponding blanket cylinder than in the case where both are rotating in opposite directions. Thus, a good washing effect is afforded.

The brush rolls 2 and 2*a* are enclosed within housings 3 and 3*a*, respectively, for preventing waste liquid, mist, etc., from being scattered toward the surroundings.

The housing 3 is provided in its wall at a position lower than the brush roll 2 with a built-in passage 5, extending substantially parallel to the brush roll 2, for supplying washing liquid to a row of a plurality of spray nozzles 4 mounted directly in a wall part 3*b* between the passage 5 and the interior of the housing 3. The spray nozzles 4 are adapted and directed to spray the washing liquid against the blanket cylinder 1 at a part thereof in front of the region of contact between the brush nozzle 2 and the blanket cylinder 1 as viewed in the rotational direction of the cylinder 1. The built-in construction of the passage 5 affords a compact design of the housing 3.

The lower housing 3*a* is also provided with a similar built-in passage 5*a* disposed above the lower brush roll 2*a* and partitioned from the housing interior by a wall part 3*c*, in which a row of a plurality of spray nozzles 4*a* are mounted. These spray nozzles 4*a* are adapted and directed to project the washing liquid against the lower blanket cylinder 1*a* at a part thereof in front, as viewed in the rotational direction thereof, of the region of contact between the brush roll 2*a* and the blanket cylinder 1*a*.

During operation, since the brush roll 2*a* rotates in the counterclockwise direction, as viewed in FIG. 2, the washing liquid is spattered upward and collides against the upper ceiling of the housing 3*a*. The washing liquid would then tend to drop onto and contaminate the surface of the blanket cylinder 1*a* if it were not for a bent and and inclined eave part 3*d* formed in the ceiling of the housing 3*a*. The droplets of the washing liquid on the ceiling flow along the lower surface of this eave part 3*d*, toward the left as viewed in FIG. 2, and, thus without dropping on the blanket cylinder 1*a*, drip from a bent portion 3*e* of the ceiling onto the brush roll 2*a*. As a result, the blanket cylinder 1*a* is not contaminated.

While the angle of this inclined eave part can be suitably selected, it has been found that a suitable value is of the order of 15 degree relative to the horizontal direction.

The upper and lower housings 3 and 3*a* are provided at their lowermost parts with troughs 6 and 6*a*, respectively, for collecting waste liquid, mist, impurities, etc. These troughs 6 and 6*a* communicate with drain pipes 7 and 7*a* for discharging waste liquid and other foreign matter out of the housings.

Each of the housings 3 and 3*a* is of integrally-formed construction of, for example, an aluminum alloy. The inner wall surface of each housing, at least at its lower part, is lined with a water-repellent and oil-repellent material such as teflon (Tradename of E. I. du Pont de Nemours & Co., Inc., U.S.A.) or a silicone material so as to prevent adhesion of contaminants.

Furthermore, each of the spray nozzles 4 and 4*a* is provided with a built-in sintered-bronze filter for preventing clogging of its spray orifice.

The bristle parts of the brush rolls 2 and 2*a*, themselves, are kept clean by respective cleaner rods 8 and 8*a* comprising wire material, such as piano wire, disposed within the range of the bristles of the brush roll and strung under tension parallell to the axes of the brush rolls.

The washing device of the invention of the above described construction operates as follows.

First, the housings 3 and 3*a* are advanced toward the blanket cylinders 1 and 1*a*, respectively, by any known mechanisms for moving the housings toward and away from the cylinders until the brush rolls 2 and 2*a* are brought into contact with the cylinders 1 and 1*a*. Thereafter, the brush rolls 2 and 2*a* are rotated in the directions of the arrows, while the cylinders 1 and 1*a* are rotated in the arrow marked directions, and washing liquid is sprayed from the two rows of spray nozzles 4 and 4*a* onto the blanket cylinders 1 and 1*a* to commence the washing operation. After a suitable quantity of the washing liquid has been thus sprayed, the spraying from the spray nozzles 4 and 4*a* is stopped, but thereafter the rotation of the blanket cylinders 1 and 1*a* and the brush rolls 2 and 2*a* is continued for further washing of the surfaces of the blanket cylinders and wiping off of the washing liquid therefrom. Thus, the washing operation is completed in a short time with good washing effect.

In the case of washing with the printing press operated at slow speed (the press being operated in some cases with the blanket cylinders rotated at a peripheral speed of 5 to 10 meters/minute), the continuous spraying of the washing liquid from the spray nozzles gives rise to an excessive supply thereof. This is because the supply flow rate of the washing liquid designed for normal printing operation at a print paper speed of 200 to 300 meters/min., or higher speed, is excessive for such slow-speed operation. Such excessive supply of the washing liquid cannot be wiped off by the brush roll from the blanket cylinder, whereby the washing liquid will drip therefrom and impair the printing. Therefore, the spraying can be carried out intermittently as described more fully hereinafter.

Furthermore, some waste washing water adhering to the bearer surfaces 9 and 9a (datum surfaces of the printing pressure) at the opposite ends of the blanket cylinders is scattered during rotation thereof and gives rise to contamination in some cases. Such contamination can be prevented by securing wipers 10 and 10a made of an elastic material such as a sponge-like material to the upper edges of the housings 3 and 3a closely confronting the blanket cylinders 1 and 1a, the wipers 10 and 10a being held in a state wherein they are pressed against their respective bearer surfaces 9, 9a as shown in FIG. 3.

While the above description concerns an example of the washing device of the invention as applied to a B-B type rotary offset press, the device can be applied with equal effectiveness also to a printing press of the satellite type or any other type.

Thus, in all of its possible applications, the washing device of this invention, although of compact form, performs efficiently its operation of washing blanket rolls without causing contamination or impairment of the printing due to waste washing liquid, mist, and other impurities. Furthermore, because of its small and compact form, the washing device of this invention will not interfere or obstruct important work such as replacement of the blanket cylinders and plate cylinders.

Figure 4:
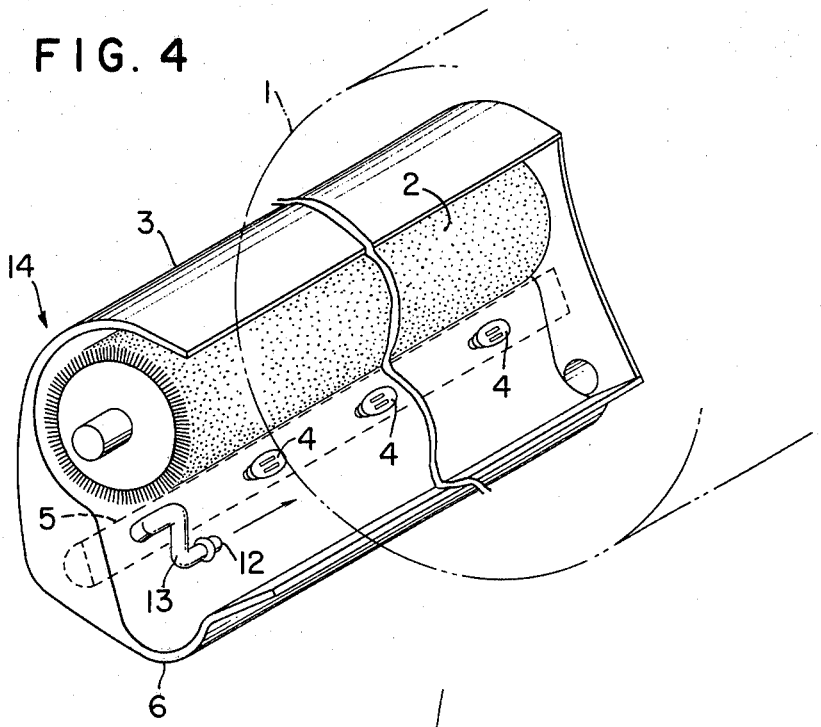
FIG. 4 is a foreshortened perspective view, with certain parts removed, showing another example of the upper washing unit of the washing device according to the invention.
Figure 5:
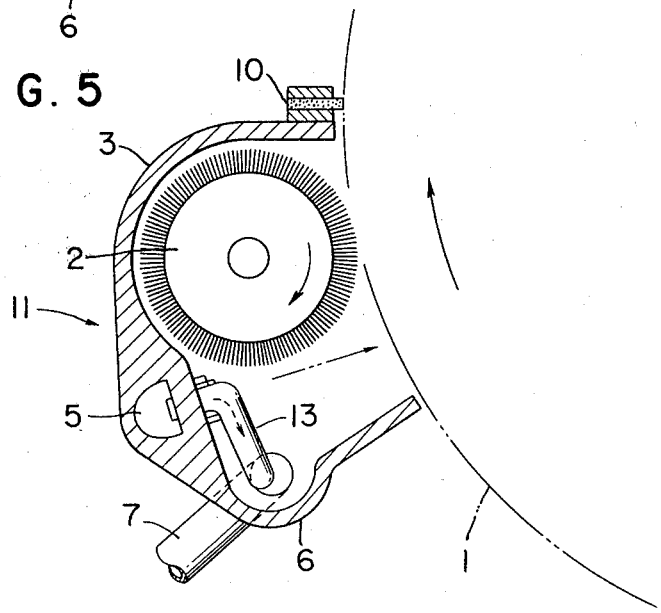
FIG. 5 is a side elevation, with parts shown in vertical section, of the unit shown in FIG. 4.
Figure 6:
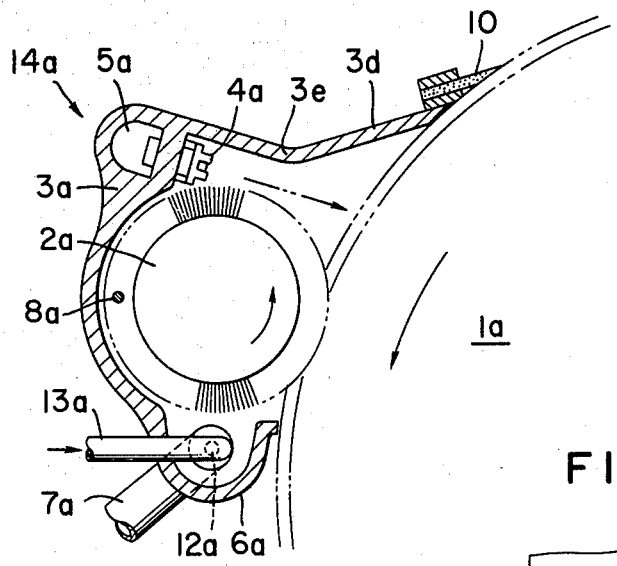
FIG. 6 is a side elevation, with parts shown in vertical section, of the lower washing unit corresponding to the upper unit illustrated in FIGS. 4 and 5.

Another example of the washing device is shown in FIGS. 4, 5 and 6, in which those parts which are same as or equivalent to corresponding parts in FIGS. 2 and 3 are designated by like reference numerals.

Referring first to FIGS. 4 and 5, the upper washing unit 14, which is essentially similar in construction and operation to the upper washing unit 11 of the preceding example, is additionally provided with flushing nozzle 12 disposed at one end of the trough 6 and directed to project a flushing jet of washing liquid along the trough 6 toward the other end. This flushing nozzle 12 is connected to and supported on one end of a pipe 13 connected at its other end to the passage 5 for supplying washing liquid.

As the upper washing unit 14 operates in the same manner as the unit 11 of the preceding example, the flushing nozzle 12 operates at the same time to eject the flushing jet of washing liquid along the trough 6 toward the other end thereof, where the waste washing liquid, together with waste liquid from the washing operation and impurities, are drained away through the drain pipe 7. Thus, the foreign matter such as ink, paper dust, and clay brushed off from the surface of the blanket cylinder 1 by the rush roll 2 are actively and positively flushed out of the housing. Since this flushing operation is carried out every time the blanket cylinder 1 is washed, accumulation of sludge-like matter as mentioned hereinbefore is effectively prevented. Accordingly, overflowing of washing liquid due to sludge accumulation and the resulting adverse effect on the printing can be positively prevented. Furthermore, manual cleaning of sludge out of the trough 6, which is troublesome and time consuming, is made unnecessary.

While a single flushing nozzle 12 is used in the above described example, a plurality of flushing nozzles can also be used and disposed at suitable positions in the lower part of the housing 3. Furthermore, instead of connecting the pipe 13 to the washing liquid supply passage 5, the pipe 13 can be connected to a separate supply pipe line for supplying water for the flushing operation.

One or more flushing nozzles (not shown) are provided in the lower washing unit 14a as indicated in FIG. 6, in which only a flushing liquid supplying pipe 13a to which a flushing nozzle is connected is shown. This pipe 13a may be connected at its upstream end to the supply passage 5a for washing liquid or to a separate supply pipe line for water.

In the washing operation of the washing device of this invention, as described hereinbefore, a washing liquid is sprayed from the spray nozzles against the blanket cylinder, during which cleaning by brushing is carried out. Then, after the spraying of the washing liquid is stopped, the brush roll, which continues to rotate, carries out drying by wiping. It has been found that, for effective washing operation, the relative peripheral speed between each blanket cylinder and its brush roll should be maintained at 400 meters/min. or higher speed.

Figure 7:
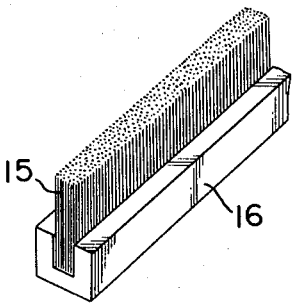
FIG. 7 is a fragmentary perspective view showing bristles of a brush roll fixedly imbedded at their root parts in a base strip.

The bristles of the brush roll 2 can be secured to the roll drum by any suitable method. One known method is to fixedly imbed the roots of the bristles 15 in a bendable base strip 16 having a channel-shaped cross section as shown in FIG. 7, and then to wind the base strip 16 around the roll drum (not shown) along a helical path or oblique elliptical paths at specific spacing intervals, the base strip 16 then being secured to the roll drum.

Figure 11:
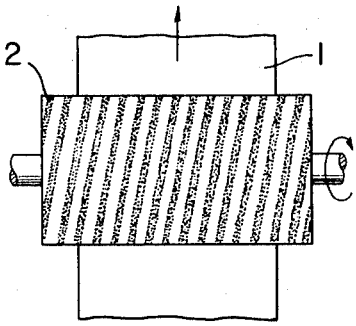

One conventional manner of disposing the base strip 16 on the roll drum is to wind it in a regular helical path from one end to the other of the roll drum as shown in FIG. 11. This arrangement, however, is apt to be disadvantageous in that, during washing operation, the brush roll 2 tends to sweep the washing liquid toward one end of the blanket cylinder, which may give rise to problems.

Figure 8:
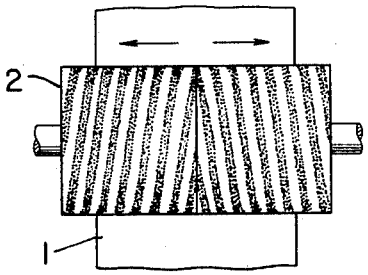
FIGS. 8 through 11 are views taken in directions perpendicular to the axes of examples of brush rolls usable in the washing device of the invention.
Figure 9:
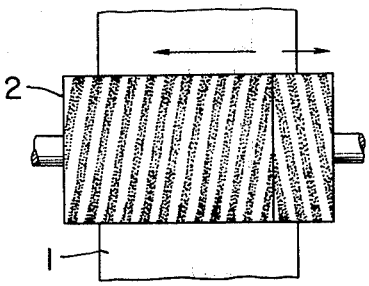
Figure 10:
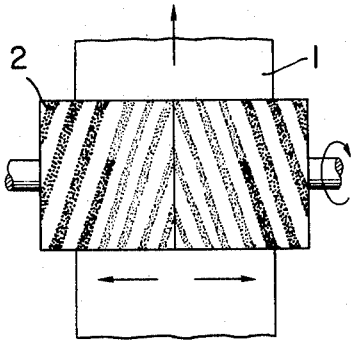

One measure for overcoming this difficulty is to provide, at the end parts of the brush roll, bristles which are stiffer than those in the intermediate parts. Another measure is to wind the base strip 16 in helical paths of opposite screw direction in equal areas as shown in FIG. 8 or in unequal areas as shown in FIG. 9. In still another measure, the base strip 16 is wound in helical paths of opposite screw direction as stated above, and, in addition, in the end parts of the roll, bristles that are stiffer than those of the intermediate parts are used as indicated in FIG. 10.

Figure 12A:
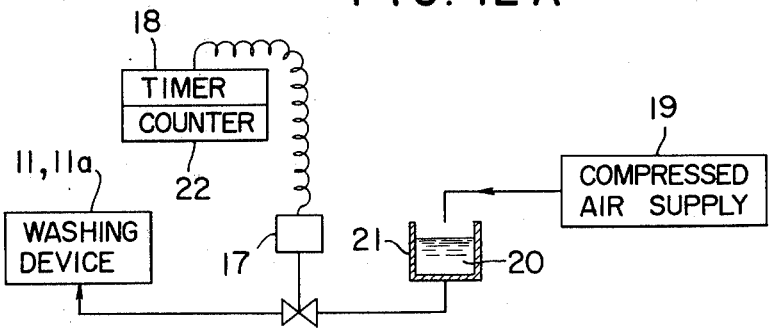
FIGS. 12A is a schematic side elevation indicating one example of means for controlling the flow of washing liquid to the washing device of the invention.
Figure 12B:
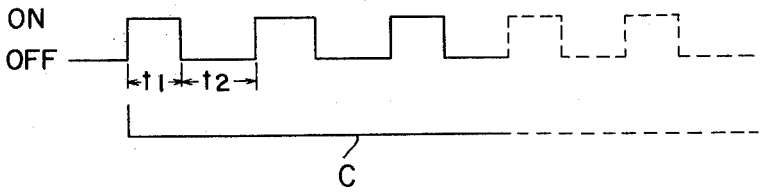
FIG. 12B is a time chart indicating one example of control by the means shown in FIG. 12A for intermittent supply of the washing liquid.

As mentioned hereinbefore, when the printing press is operated at a slow speed, which is terms of the peripheral speed of the blanket cylinders, or the speed of the print paper, may be of the order of 5 to 10 meters/min., it is desirable to spray the washing water intermittently. This can be accomplished as indicated in FIG. 12A, in which a washing liquid 20 in a tank 21 is drivable by compressed air from a compressed-air supply 19 via an electromagnetic valve 17 to the aforedescribed washing device 11, 11a of this invention. The electromganetic valve 17 can be controlled by a timer 18 combined with a counter 22 to operate according to a preset sequence as indicated in FIG. 12B, in which: $t_1$ is the period of spraying of the washing liquid; $t_2$ is period in which the spraying is stopped; and line C indicates the operation of the counter.

What is claimed is:

1. In a device for washing a blanket cylinder of a rotary offset press, which device comprises a brush roll disposed on a lateral side of the blanket cylinder for rotation about an axis parallel to the axis of the blanket cylinder, in the same rotational direction as the blanket cylinder, and in pressed state in a region of contact against the blanket cylinder, the rotational direction of the brush roll being such that the peripheral surface thereof in said region of contact moves upward, spraying means disposed above the brush roll for spraying a wash liquid against the blanket cylinder at a part thereof in front of the region of contact as viewed in the rotational direction of the blanket cylinder, and a housing enclosing the brush roll and the spray means, functioning to prevent the washing liquid from scattering undesirably to other parts of the press, and having a trough at the bottom thereof for collecting waste washing liquid and washed-off foreign matter, said housing having a ceiling plate having a bent portion from which the ceiling plate extends obliquely upward with an eave-like shape toward an edge in close proximity of the blanket cylinder, said bent portion being the lowest portion of the ceiling plate and located above the brush roll whereby droplets of the washing liquid slung upward against the ceiling plate flow downward therealong toward said bent portion to drip onto the brush roll and not onto the blanket roll.

2. A device for washing a blanket cylinder according to claim 1, further having a wiper made of an elastic flexible material mounted along said edge of the ceiling plate to elastically contact the blanket cylinder and functioning to positively prevent upward scattering of the washing liquid out of the housing.

3. A device for washing a blanket cylinder according to claim 1 further comprising a cleaner rod extending parallel to the axis of the brush roll within the range of bristles of the roll.

4. A device for washing a blanket cylinder according to claim 1, further comprising a flow control system for controlling flow of the washing liquid supplied to the spraying means.

5. A device for washing a blanket cylinder according to claim 1, wherein said ceiling plate extends obliquely from the bent portion thereof in the direction away from the blanket cylinder.

* * * * *